United States Patent [19]

Pokorny

[11] Patent Number: 4,682,375

[45] Date of Patent: Jul. 28, 1987

[54] SOFA-BED ASSEMBLY

[75] Inventor: L. Robert Pokorny, Wading River, N.Y.

[73] Assignee: Louis Pokorny Company, Inc., Ronkonkoma, N.Y.

[21] Appl. No.: 856,218

[22] Filed: Apr. 28, 1986

[51] Int. Cl.[4] ..... A47C 17/00; A47C 17/04

[52] U.S. Cl. ..... 5/13; 5/53 R; 5/53 D

[58] Field of Search ..... 5/13, 29, 45 B, 14, 5/53 R, 28, 53 D, 51 G, 51 J, 51 K

[56] References Cited

U.S. PATENT DOCUMENTS

| | | | |
|---|---|---|---|
| 4,068,328 | 1/1978 | Gerth | 5/28 |
| 4,080,672 | 3/1978 | Eakins | 5/13 |
| 4,200,941 | 5/1980 | Gill et al. | 5/29 |
| 4,253,205 | 3/1981 | Mikos | 5/29 |
| 4,398,311 | 8/1983 | Spitz | 5/13 |
| 4,399,571 | 8/1983 | Joyce | 5/13 |
| 4,571,755 | 2/1986 | Stevens | 5/13 |
| 4,571,756 | 2/1986 | Castro et al. | 5/13 |

*Primary Examiner*—Gary L. Smith
*Assistant Examiner*—Vinh Luong
*Attorney, Agent, or Firm*—Alan H. Levine

[57] ABSTRACT

A sofa-bed assembly comprising a series of sections pivoted to one another in succession and foldable between a collapsed sofa condition and an extended bed condition. A supporting linkage includes a control link pivotally connected to one of the sections, and two pivot links each pivotable about a fixed axis and each pivotally connected directly to the control link. The supporting linkage is located in its entirety below the plane containing the upper surface of the uppermost section when the sections are in their collapsed condition.

6 Claims, 4 Drawing Figures

SOFA-BED ASSEMBLY

This invention relates generally to sofa-beds, and has particular reference to an improved foldable and refoldable articulated mechanism for use within a sofa body.

The type of sofa-bed mechanism with which the invention is concerned comprises sections that are pivoted to one another in succession and are foldable between a collapsed sofa position and an extended bed position. The sections include two which lie in superposed horizontal planes when the structure is collapsed and in horizontal alignment when the mechanism is extended; they may be conveniently designated upper and lower horizontal sections. Between them, at the front of the sofa, is a front vertical section; and at the rear of the lower horizontal section it is pivotally joined to a rear vertical section, the word "vertical" signifying that in the collapsed or fully folded condition of the mechanism these sections lie in substantially vertical planes. Connecting linkages support the mechanism between the opposed side walls of a rigid sofa body which includes a front board and a back structure. The back is usually made hollow to accommodate the rearmost part of the mechanism, i.e., the rear vertical section, when it is in its fully folded condition. Helping to rigidify the sofa body is a crosspiece or breast rail extending between the side walls at the base of the back structure.

U.S. Pat. No. 3,321,777 shows an example of this general kind of assembly. In its extended condition the mechanism stretches forwardly from the sofa body to define four aligned bed-defining sections. A mattress is generally coextensive with the mechanism and foldable and unfoldable with it. The linkage system interconnects the sections in such a way that the mechanism is constrained to fold and unfold in accordance with a predetermined pattern of movement.

In the above-identified patent, reference is made to the use of a unitary front board on the sofa. This necessitates the use of a supporting linkage arrangement able to move the mechanism so that it "ducks under" the rear breast rail and "jumps over" the relatively high front board. The present invention also deals with a linkage arrangement having these capabilities.

Furthermore, with the linkage shown and described in the above-identified patent the hollow back of the sofa body must be made relatively deep to enable it to accommodate both the rear vertical section of the mechanism and the rear portion of the supporting linkage when the mechanism is in collapsed condition. Under some circumstances, particularly when it is desired to give the sofa a lighter looking, more modern styling, it is desirable to make the sofa back as shallow as possible.

U.S. Pat. No. 3,416,168 shows another example of the type of assembly to which the present invention relates. In the collapsed condition of the mechanism shown in this patent, no part of the supporting linkage projects above the seating level of the sofa, i.e., the upper surface of the upper horizontal section. Hence, the hollow sofa back can be made relatively shallow, since it need accommodate only the rear vertical section. However, the mechanism of this patent requires a sofa having a relatively high seat level so as to provide sufficient room for accommodating the four section mechanism, the entire supporting linkage, and the mattress. A high seating level gives the sofa a bulky appearance, and is therefore not acceptable for some modern furniture styling, which dictates the use of a relatively low seating level, i.e., a relatively small distance between the bottom of the sofa and the top of the sofa seat cushion.

Moreover, the S-shaped control link of the arrangement shown in U.S. Pat. No. 3,416,168, which defines the path of movement of the rear portion of the lower horizontal section, is operated by four pivot links. This is sometimes referred to as a "six link" mechanism, the six links being the one control link, the two intermediate links, the two rear links, and the fixed bracket, to which the two rear links are pivoted. While this mechanism does serve to perform its intended function, it has been found that the more links used in a mechanism, and the more pivot connections present between these links, the less smooth is the operation of the mechanism. Thus, in general, the fewer links and pivot connections employed to achieve a particular movement of the mechanism sections, the better.

In copending application Ser. No. 463,842, filed Feb. 4, 1983, now U.S. Pat. No. 4,597,115, a supporting linkage for the articulated sofa-bed sections is shown which permits the mechanism to be mounted within a sofa body having a relatively low seating level. This is accomplished because the linkage has the ability to constrain the rear end of the lower horizontal section to move through a path having a rather shallow curvature while still permitting the mechanism to duck under the breast rail and jump over the front board. However, this structure requires a sofa body having a relatively deep hollow back, since a part of the supporting linkage as well as the rear horizontal section are accommodated within the back when the sofa-bed mechanism is collapsed. In addition, the main control link pivotally connected to the rear of the lower horizontal section is operated by four additional links, namely, two auxiliary control links, a pivot link, and a coupling link.

It is an object of the present invention to provide a sofa-bed assembly which can be used in a streamlined, non-bulky sofa body having a relatively shallow back and a relatively low seating level.

It is another object of the invention to provide such an assembly wherein the rear end of the lower horizontal section is guided along a path having a relatively shallow curvature as the mechanism is moved out of the sofa body from its fully collapsed condition.

It is a further object of the invention to provide such an assembly wherein the control link of the supporting linkage for the bed sections is guided by just two pivot links, defining a "four link" mechanism, and the entire supporting linkage is located below the plane of the upper surface of the upper horizontal section when the sections are in their collapsed condition.

The preferred way of achieving these objects and the other advantages and benefits hereinafter to be pointed out is illustrated in the accompanying drawings, in which.

Figure 1:
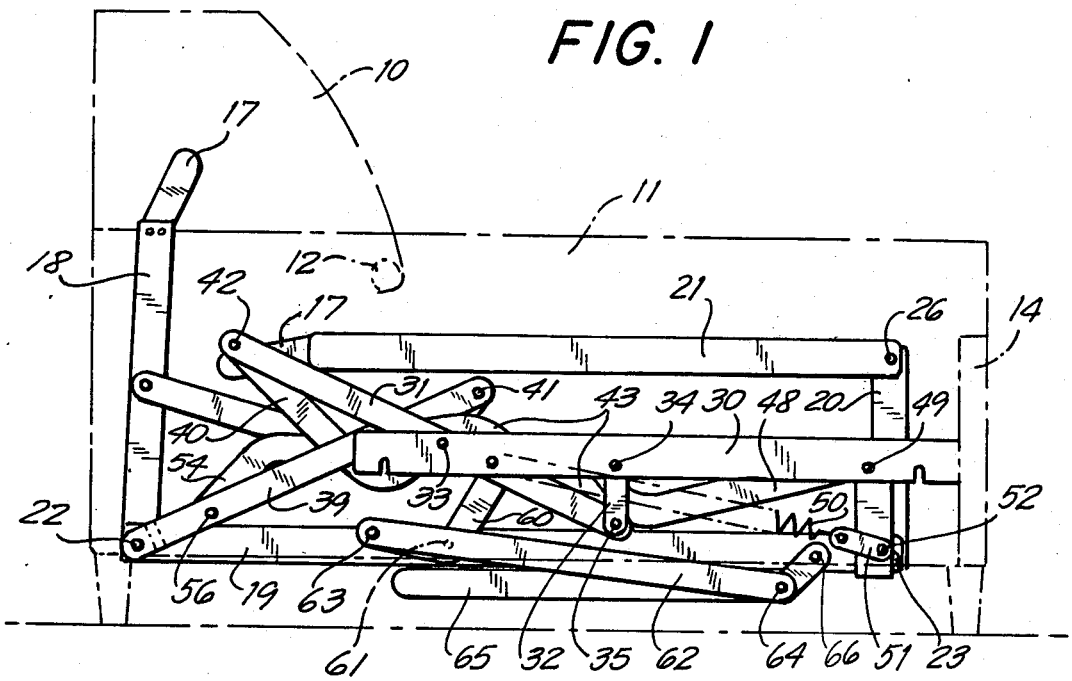
FIG. 1 is a side view of the assembly with the near side of the sofa body omitted to reveal the mechanism within it, the mechanism being shown in its fully collapsed sofa-defining condition, and parts of the sofa body being shown only schematically.
Figure 2:
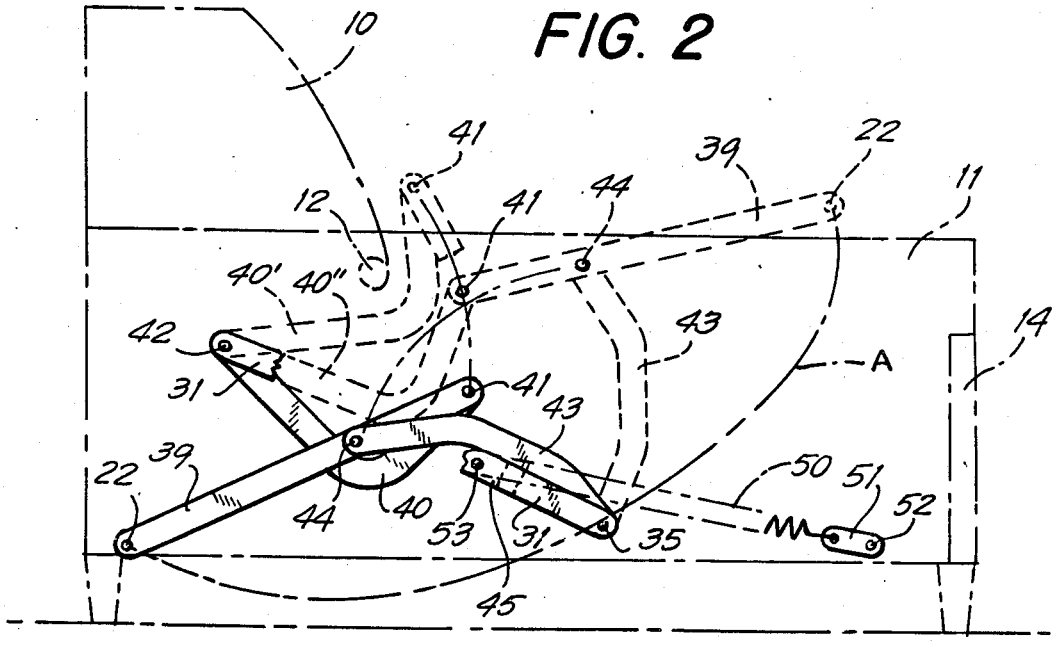
FIG. 2 is a side view of a portion of the sofa-bed mechanism, showing the path of movement of the control link as the mechanism moves between its closed and open conditions.
Figure 3:
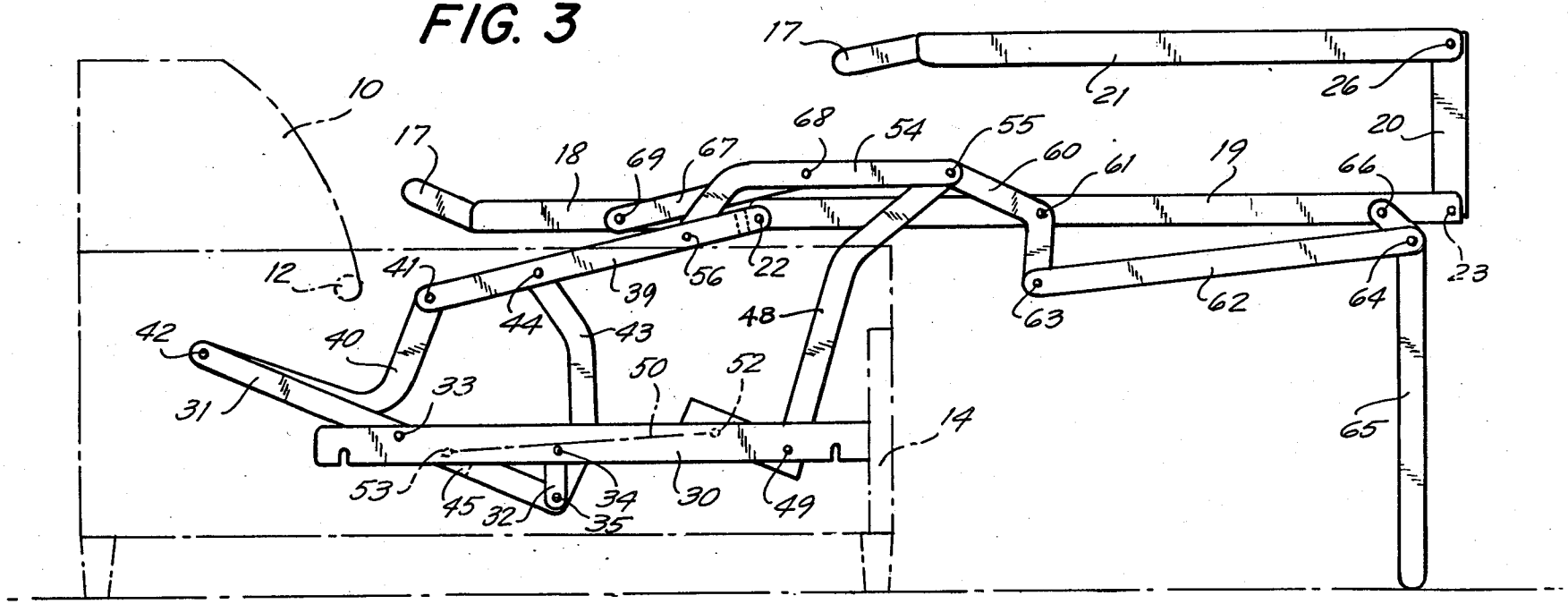
FIG. 3 is a view similar to FIG. 1 showing the rear and lower sections of the sofa-bed mechanism unfolded out of the sofa body, the front and upper sections still being folded.

The sofa body shown in FIGS. 1–3 is schematically depicted because its structural and upholstery features are not material to an understanding of the invention, except for the presence of opposed side walls 11, an upholstered back 10, a crosspiece or breast rail 12 at the base of the back a little above the level of the collapsed mechanism, and a one-piece immovable front board 14 extending along the entire length of the sofa. The board 14, as best seen in FIG. 1, has a height about equal to the housed foldable-frame mechanism when in its completely folded condition.

The back 10 of the sofa body is hollow, and affords space for the rearward part of the mechanism, and in most conventional sofa-beds, for its anchorage to the opposed sides 11. However, in the present structure, the mechanism is anchored to the sides 11 of the sofa body at a point below the back 10.

The sofa-bed mechanism comprises four sections pivoted to one another in succession, pivotal articulations between them, and a linkage for mounting the sectional unit in housing condition within the sofa body. In the fully folded condition the sections assume the relative positions shown in FIG. 1. It will be understood that these sections extend for substantially the full length of the sofa from one side 11 to the other, and that the pivotal anchorages of the mechanism to the sofa body are provided in duplicate, one at each side.

In the present mechanism, the sections comprise a rear section 18 (FIGS. 1 and 3) pivoted at its lower end 22 (as viewed in FIG. 1) to the lower horizontal section 19. The latter is pivoted at 23 to the front vertical section 20, and the latter is pivoted to the upper horizontal section 21 at 26. These pivotal connections permit the sections to lie in extended alignment when the mechanism is unfolded to its full extent, thus defining a bed. Each of the bed sections is preferably formed of opposed side rails connected at appropriate regions (as is well known) by braces extending parallel to the front board 14. The side rails are preferably angle members each of which has a horizontal flange and a vertical flange when the mechanism is extended into bed-defining condition. The free end of each of the rear vertical section 18 and the upper horizontal section 21 preferably consists of a tubular member 17 in the form of a U having short arms.

The four bed sections 18–21 of the mechanism are mounted within the sofa body by a supporting linkage pivotally connected between the bed sections and a horizontal bracket 30 fixed to the side 11 of the sofa body. An identical arrangement of supporting linkage and brackets is present at both sides of the sofa body, and hence only the arrangement at one side is illustrated and will be described. A bar 31, fixed to bracket 30 at 33, extends at an acute angle to the bracket, and a short bar 32, fixed to bracket 30 at 34, extends downwardly to a connection at 35 with the lower end of fixed bar 31. Thus, the portion of the bracket between connections 33 and 34, the portion of bar 31 between connections 33 and 35, and bar 32 constitute a rigid truss-like formation. Connections 33, 34, and 35 may conveniently be effected by rivets.

The supporting linkage includes a control link 39 pivotally connected at one of its ends to the pivotal connection 22 between the rear vertical section 18 and the lower horizontal section 19. A rear pivot link 40, having an L-shape, is connected at one of its ends to one end of control link 39 by a pivot 41. At its other end, rear pivot link 40 is connected to the upper end of fixed bar 31 by a pivot 42. A front pivot link 43 is connected at one of its ends to the lower ends of fixed bars 31 and 32 by a pivot connection at 35. The other end of front pivot link 43 is connected to control link 39 by a pivot 44 spaced from pivot 41. The terms "front" and "rear" as applied to the pivot links refer to their locations as closer to the front and rear of the sofa body, respectively.

Control link 39 and pivot links 40 and 43 constitute the arrangement for guiding the movement of the rear end 22 of lower horizontal section 19 as the mechanism moves between its fully folded condition (FIG. 1) to the fully unfolded condition of sections 18 and 19 (FIG. 3). The path of movement of rear end 22 is indicated by the broken curved line A in FIG. 2. This guiding linkage may be thought of as a "four link" mechanism, the four links being control link 39, pivot links 40 and 43, and fixed bar 31.

Figure 4:
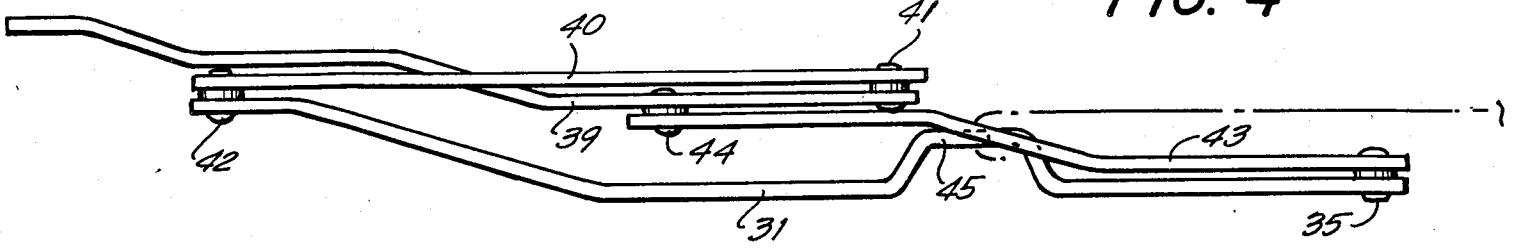
FIG. 4 is a top view of the linkage shown in full lines in FIG. 2.

Fixed bar 31 is bent at a location between its ends to form a laterally projecting portion 45 (FIG. 4), the upper surface of which defines an abutment in the path of movement of front pivot link 43 as the mechanism moves to its collapsed condition. Engagement of abutment 45 by link 43 limits further movement of link 43 and hence establishes the fully collapsed condition of the mechanism.

Before describing the operation of the mechanism, the remainder of the system illustrated in the drawings will be described, although it is conventional.

Movement of the mechanism from its collapsed condition of FIG. 1 to its unfolded condition of FIG. 3 is facilitated by an elevator arm 48 pivoted to bracket 30 at 49. A coiled tension spring 50 is connected between a short link 51, pivoted to the elevator arm at 52, and a point 53 on fixed bar 31. One end of elevator arm 48 is connected to one end of an actuating link 54 by a pivot 55, the other end of actuating link 54 being connected to control link 39 by a pivot 56. In the collapsed condition of the mechanism (FIG. 1), spring 50 urges elevator arm 48 in a clockwise direction. This force, transmitted to control link 39 through actuating link 54, helps to lift the folded mechanism out of the sofa body.

Actuating link 54 and elevator arm 48 are connected by pivot 55 to one end of a bell crank 60, the latter being pivotally mounted on lower horizontal section 19 at 61. The other end of bell crank 60 is connected to one end of a rear leg control link 62 by a pivot 63. The opposite end of link 62 is connected by pivot 64 to the rear leg 65. The leg is mounted on section 19 by a pivot 66. A rear section support link 67 is connected at one end to actuating link 54 by a pivot 68, and at its other end to rear vertical section 18 by a pivot 69. As its name implies, this link serves to support section 18 in a horizontal plane when the sections are in their extended bed condition. The remaining portion of the mechanism, including the linkage interconnecting sections 19, 20, and 21, is not shown since it is conventional and plays no part in the present invention.

The operation of the mechanism is as follows: with the mechanism in its collapsed condition of FIG. 1, the top of the front vertical section 20 is grasped and pulled upwardly and outwardly to initiate upward and forward movement of the mechanism as a whole. Aiding this movement is spring 50. During the transition from the position of FIG. 1 to that of FIG. 3, front pivot link 43 pivots clockwise about its fixed pivot 35 through an angle of a little less than 90°, as may be seen by comparing the full and broken line positions of this link in FIG. 2, the full line position being that of the collapsed condition and the broken line position being the extended condition. At the same time, rear pivot link 40 pivots counterclockwise about its fixed pivot 42 reaching its highest point indicated by broken line position 40' before returning to the broken line position 40'' which is its position in the extended bed condition of the mechanism. The movement of these two pivot links causes control link 39 to rotate through an angle of about 180°, from its full line position to its broken line position in FIG. 2.

It will be appreciated that in the collapsed sofa condition, pivot links 40 and 43 cross each other, bringing pivot 44 of front link 43 to the rear of pivot 41 of rear link 40. In addition, control link 39 is located between the fixed pivots 35 and 42 of pivot links 43 and 40, respectively. Thus, the linkage 39, 40, 43 is actually folded upon itself. As the mechanism moves out of the sofa body, pivot links 40 and 43 uncross, thereby swinging control link 39 around, is illustrated. It is this compact foldable relationship of the linkage, coupled with the flat path of movement created for pivot 22, which enables the support linkage to remain below the level of the upper surface of upper section 21, when the mechanism is fully folded, while still permitting a low seating level for the sofa.

The invention has been shown and described in preferred form only, and by way of example, and many variations may be made in the invention which will still be comprised within its spirit. It is understood therefore, that the invention is not limited to any specific form or embodiment except insofar as such limitations are included in the appended claims.

I claim:

1. In a sofa-bed assembly having a stationary bracket with respect to a sofa body and a series of sections pivoted to one another in succession, the sections being foldable between a collapsed sofa condition and an extended bed condition, and the sections including an upper horizontal section having an upper surface defining the seating level of the sofa when the sections are in collapsed condition, a supporting linkage pivotally connecting the sections to the bracket for constraining the sections to fold and unfold in acccordance with a predetermined pattern of movement, the supporting linkage including:

a control link pivotally connected directly to one of the sections, and two pivot links, each pivot link being directly pivotable about an axis fixed with respect to the stationary bracket and each pivot link being pivotally connected directly to the control link, the supporting linkage being located in its entirety below the plane containing the upper surface of the upper horizontal section when the sections are in their collapsed condition.

2. A sofa-bed assembly as defined in claim 1 wherein when the sections are in their collapsed condition, the control link is located between the fixed axes about which the two pivot links are pivotable.

3. A sofa-bed assembly as defined in claim 1 wherein the two pivot links include a rear pivot link and a front pivot link, the fixed axis about which the rear pivot link is pivotable being located rearwardly of the fixed axis about which the front pivot link is pivotable, and the pivot connection between the rear pivot link and the control link being located in front of the pivot connection between the front pivot link and the control link when the sections are in their collapsed condition.

4. A sofa-bed assembly as defined in claim 1 wherein the series of sections includes a rear vertical section, a lower horizontal section, a front vertical section, and an upper horizontal section, the control link being pivotally connected to the sections in the region of the pivot connection between the rear vertical section and the lower horizontal section.

5. A sofa-bed assembly as defined in claim 4 wherein when the sections are in their collapsed condition, the only portion of the entire assembly which extends above the plane containing the upper surface of the upper horizontal section is the rear vertical section.

6. A sofa-bed assembly as defined in claim 1 including a bar fixed with respect to the stationary bracket, each of the pivot links being pivotally mounted on the bar, the bar having a laterally projecting abutment surface, and one of the pivot links engaging the abutment surface when the sections are in their collapsed condition so as to limit the folding movement of the assembly.

* * * * *